US006772822B2

(12) United States Patent
Wu et al.

(10) Patent No.: US 6,772,822 B2
(45) Date of Patent: Aug. 10, 2004

(54) PRESSURE RELEASING MATERIAL FEEDING SCREW ROD USED IN MELTING METAL MATERIAL INJECTION MACHINE

(76) Inventors: Ji-Yin Wu, 235 Chung-Ho Box 8-24, Taipei (TW); Ho Wang, 235 Chung-Ho Box 8-24, Taipei (TW); Jian Shun Chiu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/174,810

(22) Filed: Jun. 20, 2002

(65) Prior Publication Data

US 2003/0234094 A1 Dec. 25, 2003

(51) Int. Cl.[7] ..... B22D 17/00
(52) U.S. Cl. ..... 164/312; 164/900
(58) Field of Search ..... 164/113, 312, 164/900

(56) References Cited

U.S. PATENT DOCUMENTS 5,685,357 A * 11/1997 Kato et al. ..... 164/113
6,599,004 B2 * 7/2003 Barr ..... 366/88

* cited by examiner

*Primary Examiner*—Kiley Stoner
*Assistant Examiner*—Len Tran

(57) ABSTRACT

A pressure releasing material feeding screw rod used in a melting metal material injection machine is disclosed. A plurality of adjacent threads are arranged along a longitudinal direction of the screw rod. The threads include a plurality of normal pressure threads and a plurality of pressure reduction threads which are alternatively arranged. An edge of each pressure reduction threads have a gap with the wall of the material feeding cylinder, or the pressure reduction threads is made of flexible plate. When the normal pressure threads push the melting material forwards, as the melting material in the material feeding cylinder generates an overlarge reacting force on a surface of the normal pressure thread, the gap will receive the material or the flexible pressure reduction threads will form a gap so that melting material can pass through this gap. Then the material will be pushed by next normal pressure thread.

2 Claims, 4 Drawing Sheets

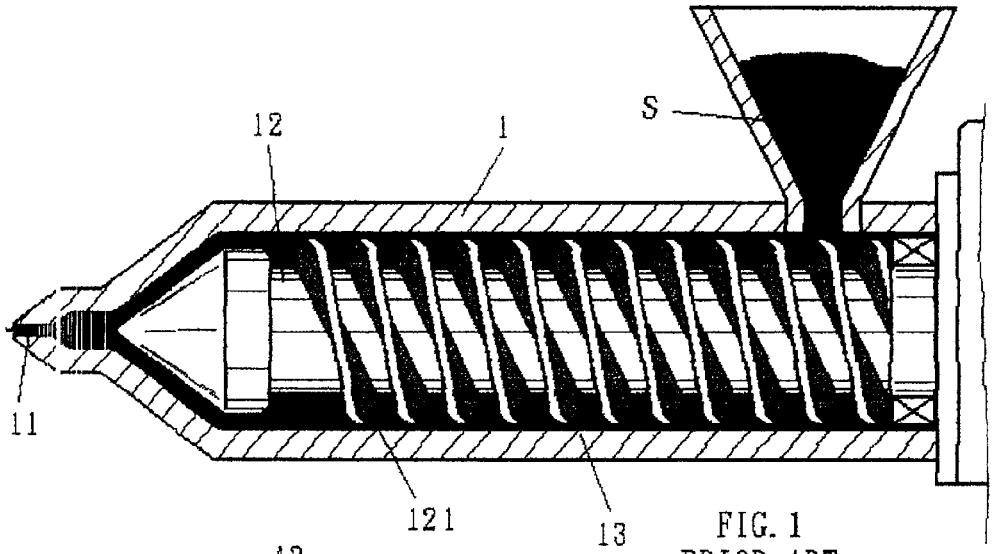
FIG. 1
PRIOR ART
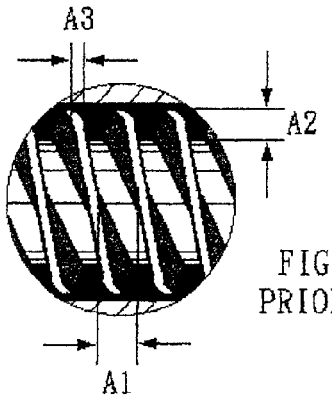
FIG. 1-A
PRIOR ART

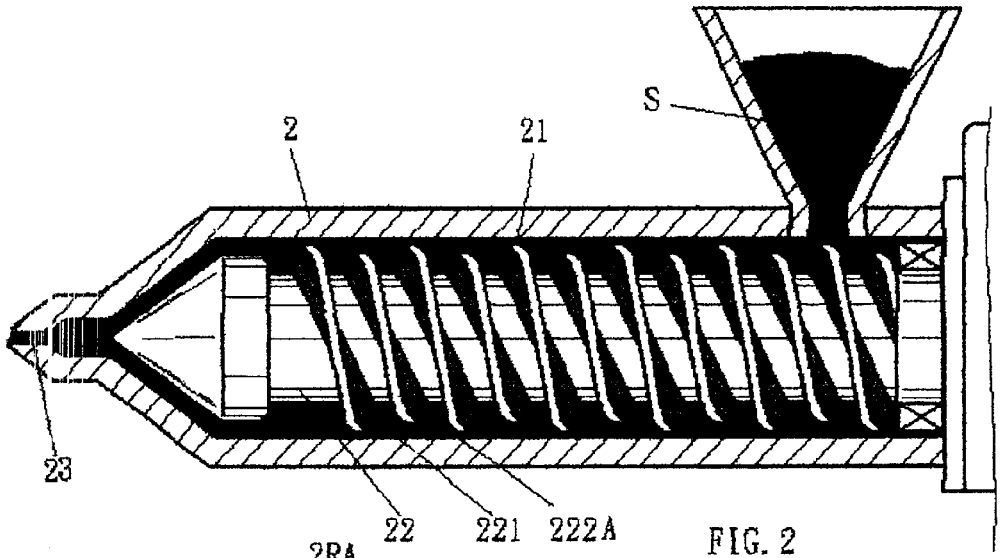
FIG. 2
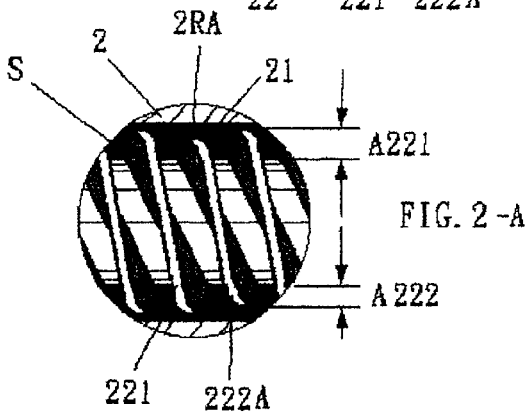
FIG. 2-A

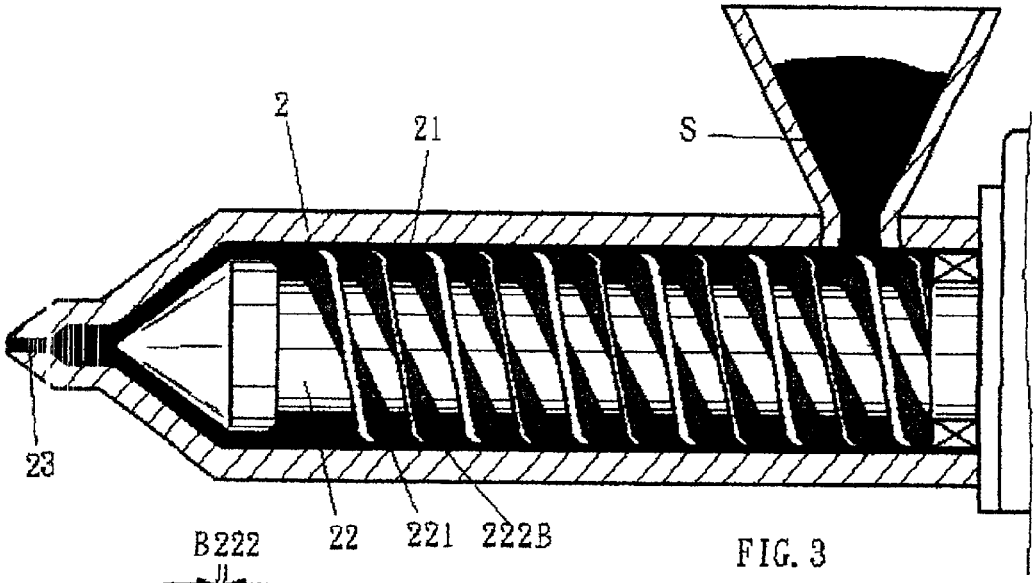
FIG. 3
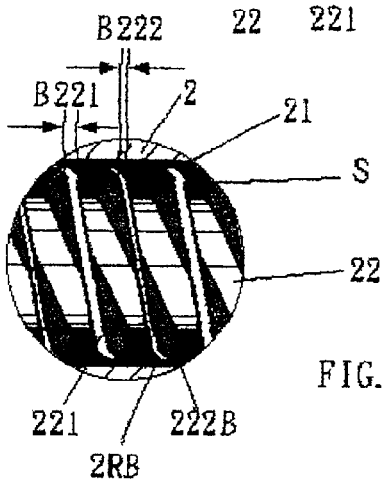
FIG. 3-A

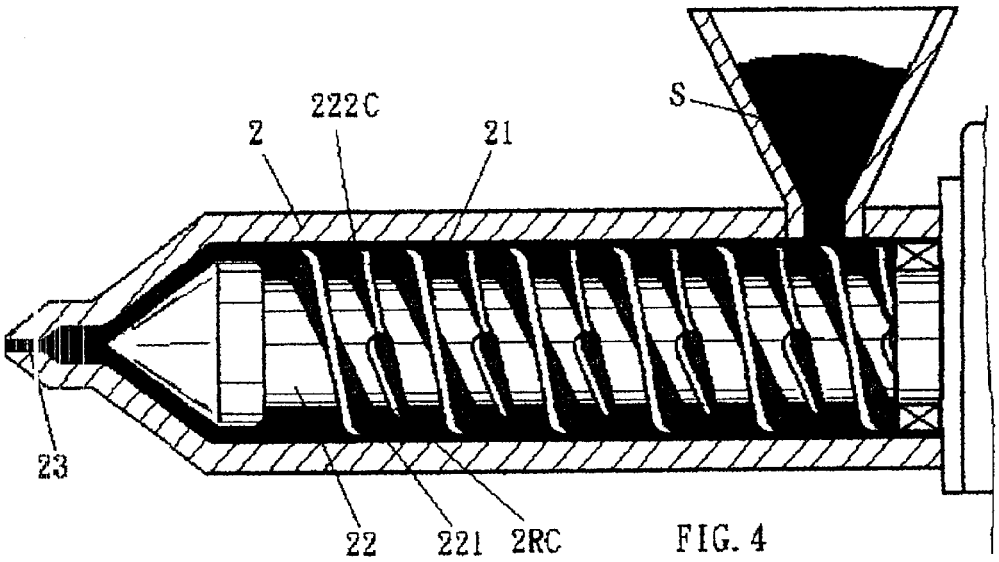
FIG. 4
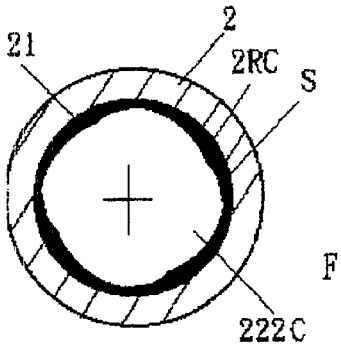
FIG. 4-A

PRESSURE RELEASING MATERIAL FEEDING SCREW ROD USED IN MELTING METAL MATERIAL INJECTION MACHINE

FIELD OF THE INVENTION

The present invention relates to screw rods, and particularly to a pressure releasing material feeding screw rod used in a melting metal material injection machine.

BACKGROUND OF THE INVENTION

FIG. 1 shows a prior art injection machine used with a mold. In use, the material is melt as melting material S which is then pushed by a material feeding device 1 to the mold through an injecting nozzle 11. Conventionally, the material is plastic material since the plastic material has lower melting point, fine particles and uniform particle sizes. Thereby, the material feeding screw rod 12 with a simple structure can be used.

However, recently, other materials, especially metals, such as magnesium, aluminum, etc., are used in many products, for example, computer casing. The melting point, cooling speeds, and other physical properties are different from the prior plastic material so that the operation and machine used must be modified.

The density and mass of metal are higher than plastics, but the uniformity thereof is worse than plastics. Referring to FIG. 1, a screw rod has threads 121 will push melting material forwards each two threads has a uniform gap A1, height A2 and width A3). Thereby, the pressure from the melting material applied to the thread can not be released. In one modified structure, the screw rod is divided into three sections, the threads in different sections have different distances, heights and widths, but in this modified prior art, the melting metal material is possibly left in gaps between two threads of the same section. Thereby, the pressure can not be released.

If the screw rod 12 moves forwards continuously, the melting metal material will accumulate between two threads and then apply a force to the surfaces of the threads. Thereby, the cylinder 13 will accumulate too much material therein. Through a long time period, the screw rod 12, threads 121 and cylinder 13 will be destroyed. In some developed designs, the strength of the screw rod 12 and threads 121 are enhanced, but this will further increase the possibility of the accumulation of material in the cylinder.

SUMMARY OF THE INVENTION

Accordingly, the primary object of the present invention is to provide a pressure releasing material feeding screw rod used in a material feeding cylinder of a material feeding device of the melting metal material injection machine. A plurality of adjacent threads are arranged along a longitudinal direction of the screw rod. The threads include a plurality of normal pressure threads and a plurality of pressure reduction threads. Each of the normal pressure threads is positioned in front of a respective pressure reduction thread; the normal pressure thread can push the melting material toward the injecting nozzle. An edge of each pressure reduction threads have a gap with a wall of the material feeding cylinder. By the arrangement of the pressure reduction thread, when the normal pressure threads push the melting material forwards, as the melting material in the material feeding cylinder generates an overlarge reacting force on a surface of the normal pressure thread, the gap will receive the material. Then the material will be pushed by next normal pressure thread.

Another object of the present invention is to provide a pressure releasing material feeding screw rod. A plurality of adjacent threads are arranged along a longitudinal direction of the screw rod; the threads include a plurality of normal pressure threads and a plurality of pressure reduction threads. Each of the normal pressure threads is positioned in front of a respective pressure reduction thread. The normal pressure thread can push the melting material toward the injecting nozzle; the pressure reduction threads are flexible. By the arrangement of the pressure reduction thread, when the normal pressure threads push the melting material forwards, as the melting material in the material feeding cylinder generates an overlarge reacting force on a surface of the normal pressure thread, the pressure reduction thread will be pushed to bent backwards so as to form a gap between the pressure reduction threads and a wall of the material feeding cylinder. Then the material will pass through the gap; and then the material is pushed by next normal pressure thread.

The various objects and advantages of the present invention will be more readily understood from the following detailed description when read in conjunction with the appended drawing.

BRIEF DESCRIPTION OF THE DRAWINGS

FIG. 1 is an axial cross sectional view of a prior art material feeding screw rod.

FIG. 1A is a radial cross sectional view of a prior art material feeding screw rod.

FIG. 2 is an axial cross sectional view of a material feeding screw rod according to the first embodiment of the present invention.

FIG. 2A is an axial cross sectional view of a material feeding screw rod according to the first embodiment of the present invention.

FIG. 3 is an axial cross sectional view of a material feeding screw rod according to the second embodiment of the present invention.

FIG. 3A is an axial cross sectional view of a material feeding screw rod according to the second embodiment of the present invention.

FIG. 4 is an axial cross sectional view of a material feeding screw rod according to the third embodiment of the present invention.

FIG. 4A is an axial cross sectional view of a material feeding screw rod according to the third embodiment of the present invention.

DETAILED DESCRIPTION OF THE PREFERRED EMBODIMENTS

2 and 2A, the preferred embodiment of the present invention is illus Referring to Figs. trated. The present invention is mainly used in the material feeding screw rod 22 in the material feeding cylinder 21 of the material feeding device 2 of a melting metal material injection machine.

A plurality of adjacent threads 22A are arranged along the longitudinal direction of the screw rod 22. The threads 22A include a plurality of normal pressure threads 221 and a plurality of pressure reduction threads 222. Each of the normal pressure threads 221 is positioned in front of a respective pressure reduction thread 222. The normal pressure thread 221 may push the melting material S toward the injecting nozzle 23. Each pressure reduction thread 222 is positioned after a respective normal pressure thread 221. The pressure reduction threads 222 have a gap 2RA with the wall of the material feeding cylinder 21. By the arrangement of the pressure reduction threads 222, when the normal pressure threads 221 push the melting material S forwards, the melting material S in the material feeding cylinder 21 perhaps generates an overlarge reacting force on the surface of the normal pressure thread 221. Then, the material will pass through pressure reduction threads 222, and then the material will be pushed by next normal pressure thread 221. Thus, the cylinder, pressure reduction threads 222 and normal pressure threads 221 will not be destroyed or generate cracks.

Referring to FIGS. 2 and 2A, the height of each pressure reduction thread 222 is A222 and the height of each normal pressure thread 221 has a height A221. It is shown that A222 is shorter than A221 so that the gap 2RA to the wall of the cylinder is formed. Thereby, the melting material S may pass through the gap 2RA to move backwards to be resisted by next normal pressure thread 221.

Referring to FIGS. 3 and 3A, the pressure reduction threads 222 are formed by flexible materials, for example the wall of the pressure reduction thread 222 is thinner as B222 in the drawings, so that as the melting material S move from the front normal pressure thread 221 to resist against the pressure reduction threads 222. Then the pressure reduction threads 222 will be pushed backwards. Then a gap 2RB between the edge of the pressure reduction thread 222 and the wall of the cylinder is formed. Thus the material will move backwards to be resisted by the wall of next normal pressure thread 221.

With reference to FIGS. 4 and 4A, the periphery of the pressure reduction thread 222 is formed with a plurality of concave portions with a gap 2RC to the wall of the cylinder so that the surplus material can move backwards through the concave portions.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

We claim:

1. A molten metal injection pressure feeding screw rod used in a material feeding cylinder of a material feeding device of a melting metal material injection machine; characterized in that:

a plurality of adjacent threads are arranged along a longitudinal direction of the screw rod; the threads include a plurality of normal pressure threads and a plurality of pressure reduction threads; each of the normal pressure threads is positioned in front of a respective pressure reduction thread; an edge of each pressure reduction threads have a gap with a wall of the material feeding cylinder; wherein by the arrangement of the pressure reduction thread, when the normal pressure threads push the melting material forwards, as the melting material in the material feeding cylinder is too much, it will generate an overlarge reacting force on a surface of the normal pressure thread, and the melting material will pass through the gap to resist against next normal pressure thread; then the melting material will be pushed by the next normal pressure thread; and wherein a height of the pressure reduction thread is shorter than that of the normal pressure thread so as to form the gap.

2. The pressure releasing material feeding screw rod as claimed in claim 1, wherein a surface of the pressure reduction threads is formed with a plurality of concave portion.

* * * * *